United States Patent [19]

Seaton

[11] 4,271,994

[45] Jun. 9, 1981

[54] FLEX ROD ASSEMBLY FOR A STOPPER VALVE IN A BOTTOM POUR LADLE

[75] Inventor: William W. Seaton, Dexter, Mich.

[73] Assignee: Combustion Engineering, Inc., Windsor, Conn.

[21] Appl. No.: 92,802

[22] Filed: Nov. 9, 1979

[51] Int. Cl.[3] ..... B22D 41/10

[52] U.S. Cl. ..... 222/602; 222/504

[58] Field of Search ..... 222/602, 504, 559; 251/319

[56] References Cited

U.S. PATENT DOCUMENTS 3,703,248 11/1972 Seaton ..... 222/602

3,762,605 10/1973 Seaton ..... 222/602

FOREIGN PATENT DOCUMENTS 221232 7/1968 U.S.S.R. ..... 222/602

*Primary Examiner*—David A. Scherbel

*Attorney, Agent, or Firm*—Robert L. Olson

[57] ABSTRACT

Apparatus for aligning the stopper valve (14) with the seat (12) in a bottom pour ladle (10), including a locking arrangement (36) which can be loosened to permit the valve (14) to properly close on the seat (12). The locking arrangement (36) is then locked into position with the stopper valve (14) in true alignment with the seat (12).

1 Claim, 2 Drawing Figures

FLEX ROD ASSEMBLY FOR A STOPPER VALVE IN A BOTTOM POUR LADLE

BACKGROUND OF THE INVENTION

One present means of pouring metal into molds in accurate, predetermined amounts, is by means of a bottom pour ladle, having a substantially vertically movable ceramic stopper valve cooperating with the ceramic seat or orifice contained in the bottom thereof. During operation, misalignment of the stopper valve and orifice can occur due to thermal expansion of the ladle. This causes undue wear of the ceramic stopper valve and/or orifice and leads to ultimate molten metal leakage in a short period of time.

SUMMARY OF THE INVENTION

In accordance with the invention, apparatus is provided for permitting alignment of the stopper valve with the seat or orifice in a bottom pour ladle. Locking means are provided which can be loosened to permit alignment. Thereafter the locking means are locked, holding the valve in proper alignment with the seat or orifice.

DESCRIPTION OF THE PREFERRED EMBODIMENT

Figure 1:
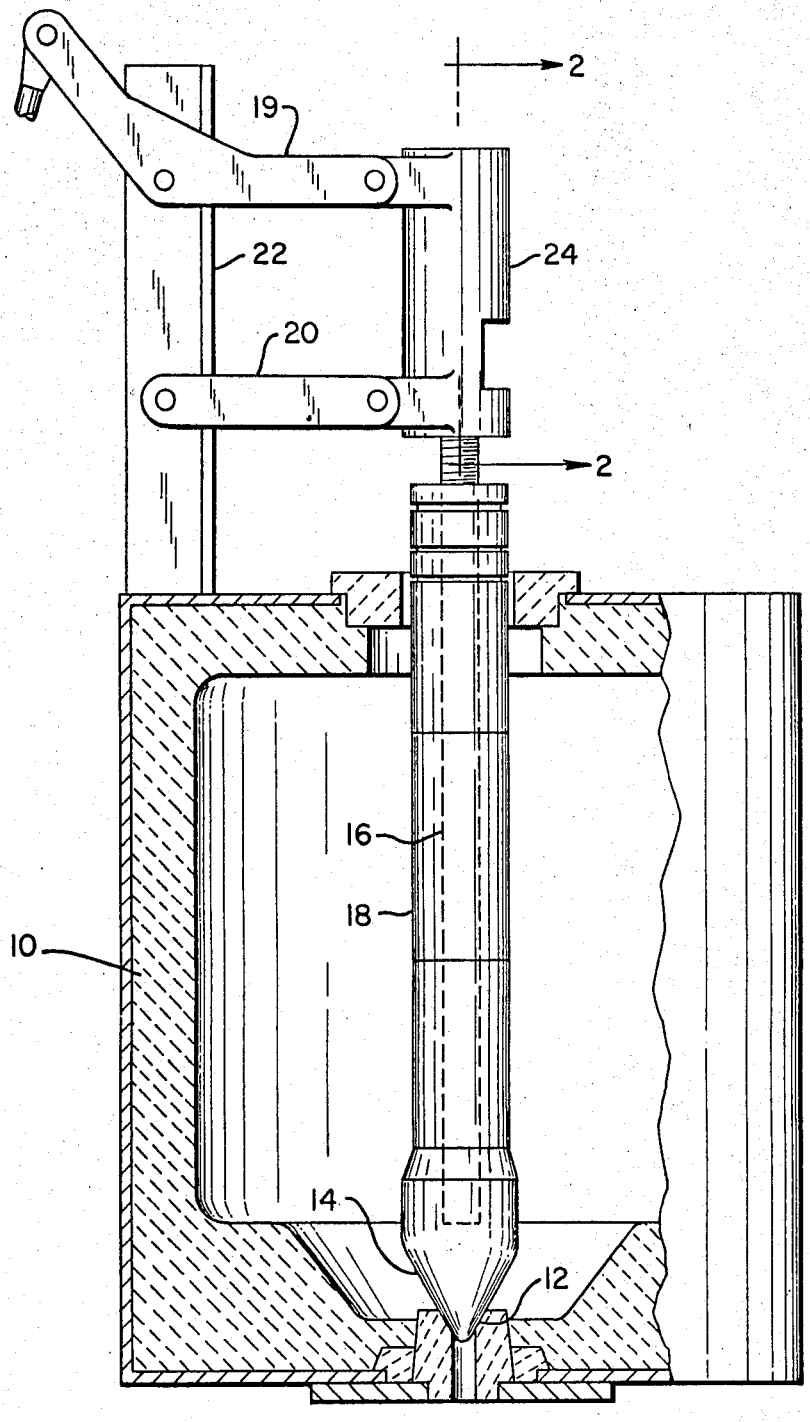
FIG. 1 is a side view partially in section of a bottom pour ladle.

Looking now to FIG. 1, 10 denotes a refractory lined pouring ladle from which molten metal can be poured. The ladle has a bottom outlet nozzle 12, and a stopper valve 14, for controlling flow of metal from the ladle. The stopper valve is mounted on the end of the stopper rod 16. This rod is surrounded by refractory sleeves 18 to protect it from the molten metal within the ladle 10.

Secured to a housing 24 is an upper dog leg lever 19 and a lower lever 20. Both levers are pivotally connected to a stationary vertical post 22, and together with the housing 24 secured to the upper end of rod 16 they form a parallelogram. The opposite end of dog leg lever 19 is actuated in any suitable manner to control the opening and closing of stopper valve 14.

Figure 2:
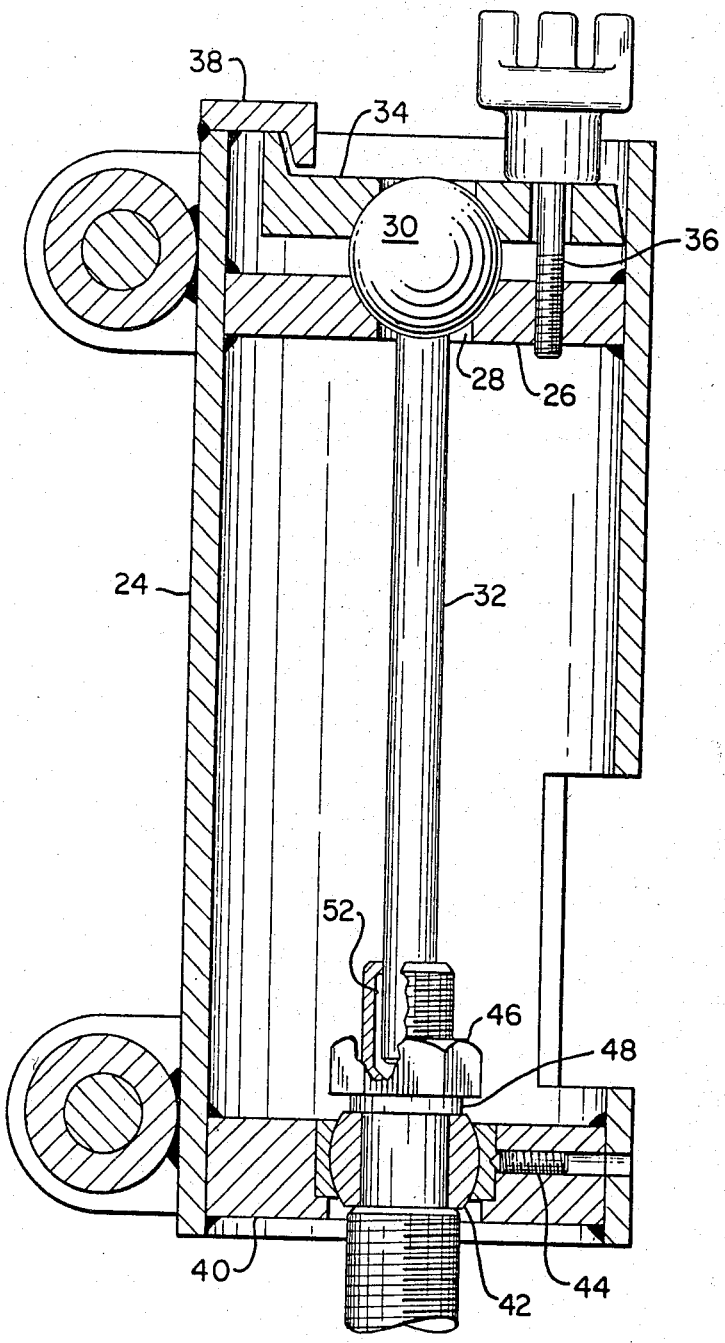
FIG. 2 is an enlarged view of the flex rod assembly of the invention, which permits alignment of the stopper valve and its seat.

Looking now to FIG. 2, the interior of housing 24 is shown in detail. Located within and welded horizontally to the interior upper portion of the housing 24 is a circular seating plate 26. Centrally located on the upper side of the seating plate is an indented spherical seat. A small diameter clearance hole 28 extends entirely through the plate. The function of the seating plate 26 is to provide a seat for the alignment ball 30. Extending through opening 28 is flex rod 32, which is integral with ball 30. Resting on the upper side of the alignment ball 30 is a locking plate 34. The locking plate is provided with a spherical indentation to accommodate ball 30. Ball 30 is clamped between plates 26 and 34 by bolt 36 which is threaded into the seating plate 26. By threading bolt 36 down into plate 26, the locking plate is forced against and pivots about overhang 38. When tightened, alignment ball 30, along with flex rod 32, are locked in a given position.

Located within and horizontally welded to the interior of the bottom portion of housing 24 is a bearing plate 40. Bearing plate 40 provides a seat for the ball bushing 42. This ball bushing 42 is held in place by three set screws 44 located radially in the bearing plate. Attached to the ball bushing 42 and held in position by locking nut 46 and lock washer 48 is the stopper rod 16. The upper end of rod 16 is provided with a counter bored hole 52 which receives the lower end of the flex rod 32. This forms a universal joint, permitting three dimensional movement between the two rods when adjustment is necessary.

The above described apparatus allows for the misalignment of the stopper rod 16 in relation to the housing 24, while still having the stopper valve 14 properly seated in opening 12 when readjusted.

The manner in which the apparatus can be adjusted to cause proper seating after the parts have become misaligned, will now be described. Bolt 36 is first loosened, allowing the free movement of the alignment ball 30. Stopper valve 14 is properly seated in orifice 12. Lateral misalignment is transferred up stopper rod 16 to the ball bushing 42 which compensates at its pivot point. Flex rod 32 adjusts according to the amount of pivot in ball bushing 42. Bolt 36 can then be tightened, locking the alignment ball 30 and flex rod 32 in their proper positions. During operation, flex rod 32 is capable of some flexing, allowing controlled lateral movement of the stopper valve 14.

I claim:

1. Apparatus for aligning the stopper valve with its seat in a bottom pour ladle, including a bottom pour ladle, a valve seat surrounding a discharge opening in the bottom of the ladle, a stopper valve for controlling opening and closing of the opening, a first stopper rod connected at its lower end to the stopper valve, a parallelogram actuator for the stopper valve, a movable housing forming one side of the parallelogram actuator, a plate secured in the bottom portion of the housing, said plate having an opening therein, the first stopper rod extending up through the opening in such a manner that horizontal movement of the first rod is prevented at this location, a second rod pivotally secured to the top portion of the housing, a universal joint connecting the bottom of the second rod to the top of the first stopper rod, and releasable locking means associated with the second rod, which in a first position permits pivoting of the second rod with respect to the housing, and in a second position locks the second rod to the housing, preventing pivoting therebetween.

* * * * *